US007837295B2

(12) United States Patent
Ehresmann et al.

(10) Patent No.: US 7,837,295 B2
(45) Date of Patent: Nov. 23, 2010

(54) MEASURING METHOD AND ARRANGEMENT TO DETERMINE THE PLAY OF AN INK JET CARTRIDGE PIVOT UNIT

(75) Inventors: Rainer Ehresmann, Berlin (DE); Ralf Mueller, Berlin (DE); Wolfgang Muhl, Hohen Neuendorf (DE); Sabine Roth, Berlin (DE)

(73) Assignee: Francotyp-Postalia GmbH (DE)

( * ) Notice: Subject to any disclaimer, the term of this patent is extended or adjusted under 35 U.S.C. 154(b) by 296 days.

(21) Appl. No.: 12/182,215

(22) Filed: Jul. 30, 2008

(65) Prior Publication Data

US 2009/0033706 A1 Feb. 5, 2009

(30) Foreign Application Priority Data

Jul. 31, 2007 (DE) ..... 10 2007 035 875

(51) Int. Cl.
*B41J 2/165* (2006.01)

(52) U.S. Cl. ..... 347/32; 347/33; 347/29

(58) Field of Classification Search ..... 347/26, 347/28, 29, 32, 33
See application file for complete search history.

(56) References Cited

U.S. PATENT DOCUMENTS 5,548,309 A * 8/1996 Okubo et al. ..... 347/33
6,224,187 B1 * 5/2001 Inten et al. ..... 347/32
2005/0274208 A1 12/2005 Bader et al.
2007/0097173 A1 5/2007 Hubler et al.
2007/0120886 A1 5/2007 Turner et al.
2007/0126831 A1 6/2007 Suzuki et al.
2007/0282764 A1 12/2007 Ehresmann et al.
2008/0126670 A1 5/2008 Ehresmann et al.

FOREIGN PATENT DOCUMENTS

DE 200 12 946 U1 10/2000
DE 100 62 012 A1 2/2002

* cited by examiner

*Primary Examiner*—Lam S Nguyen
(74) *Attorney, Agent, or Firm*—Schiff Hardin LLP

(57) ABSTRACT

A measuring arrangement and measurement method determine the play of a cartridge pivot unit of an inkjet printing system that has at least one stop for the cartridge pivot unit. The cartridge pivot unit is driven by a first motor via a gear train and is equipped with a first movement sensor to establish a movement of the cartridge pivot unit upon leaving the stop. The cartridge pivot unit moves only when the play of the gear train is overcome. The stop for the cartridge pivot unit is formed by a mobile cleaning and sealing station. A counter is provided to count pulses, the count being representative of the play of the gear train of the cartridge pivot unit counting begins with leaving the mobile stop and continues until the movement of the cartridge pivot unit upon leaving the stop again ensues in conformity with the actuation by the first motor.

21 Claims, 5 Drawing Sheets

MEASURING METHOD AND ARRANGEMENT TO DETERMINE THE PLAY OF AN INK JET CARTRIDGE PIVOT UNIT

BACKGROUND OF THE INVENTION

1. Field of the Invention

The invention concerns a measuring arrangement and a measurement method to determine the play of a cartridge pivot unit of an inkjet printing system. The method serves to detect and compensate for age-dependent variations of the play and to assess whether the required precision in the pivoting of the cartridge pivot unit into the printing position can still be maintained. The invention is used in printing devices with relative movement between an inkjet print head and the print item, in particular in franking and/or addressing machines and in other mail processing apparatuses.

2. Description of the Prior Art

Pivot movements of a print head are known from German Utility Model DE 200 12 946 U1.

An acceptance unit is known from DE 10062012 A1 for at least one inkjet print head that is arranged so that it can move in rotation around a rotation axis that lies parallel to the transport direction of mail pieces and that, driven by a motor and controlled by a microprocessor, can be selectively pivoted at least into one printing position and one service position. A service position at a sealing station is occupied after longer printing pauses for, among other things, clearing the print head.

A front view of the franking machine of the Centormail® type and its electronics were at least partially shown in the German Utility Model DE 20 2006 008952 U1 ("Arrangement to change customer data of a franking device").

A pivot mechanism and a control device for pivoting into a cleaning and sealing position is shown for the same franking machine in DE 10 2005 052 150 A1 ("Device to clean an inkjet print head").

A method and device for clearing an inkjet print head of an inkjet printing system are known from EP 1792955 A1, wherein at least one ink cartridge equipped with a print head is arranged in an acceptance unit that is also designated as a cartridge pivot unit. This is driven in steps by an actuator and can be selectively pivoted (controlled by a microprocessor) at least into a printing position and into a clearing position near the printing position. While it is possible for the cartridge pivot unit to be moved during the clearing, for the purpose of printing the printing position should be controlled as exactly as possible. The cartridge pivot unit has a rotation axle with a rotation angle transmitter with which the position achieved upon a rotation of the axle can be determined. The cartridge pivot unit can have too much play even given a correctly adjusted rotation angle transmitter, which can lead to a malfunction of the machine.

SUMMARY OF THE INVENTION

An object of the present invention is to provide a measuring arrangement to determine the play of a cartridge pivot unit and a corresponding measurement method, wherein testing evaluation) of the play is made possible in a simple manner and without opening the machine.

The measuring arrangement has a microcomputer that is connected with a rotation movement sensor and with the first motor for its activation to pivot the cartridge pivot unit. The first motor is charged with pulses of corresponding energy, controlled by said microcomputer. The cartridge pivot unit is pivoted dependent on the supplied energy by means of a gearing train arranged between the first motor and the cartridge pivot unit. The movement of the cartridge pivot unit does not ensue in conformity with the actuation by the first motor if play of the gearing train must first be overcome. The play is permitted to completely occur upon pivoting of the cartridge pivot unit onto a mechanical stop. Movement is no longer detected by the rotation movement sensor that supplies the measurement values. The microcomputer is provided to determine and evaluate measurement values. A microprocessor of the microcomputer is programmed (by a program stored in the program memory of the microcomputer) to reverse the rotation direction of the first motor and therefore the movement direction of the cartridge pivot unit at a first point in time, with the first point in time being reached when the play of the train of the cartridge pivot unit has been permitted to completely occur. The microcomputer loads a counter that counts pulses as of the first point in time and has a working memory to store the digitized measurement values determined immediately following. A digital comparator that compares the immediately following digitized measurement values serves to evaluate measurement values. The microprocessor of the microcomputer is programmed to stop the counter at a second point in time when the difference of the immediately adjacent digitized measurement values is greater than a threshold, or when the difference of the immediately adjacent digital measurement values in successive measurements rises or changes. The counter state is stored as "play" in the working memory.

A measurement method to determine the play of a cartridge pivot unit is based on generating pulses with which the drive is charged, driving the cartridge pivot unit, and determining measurement values corresponding to a pivoting of the cartridge pivot unit. The digital measurement values, measured by a rotation movement sensor (in particular a rotation angle transmitter) and generated by a converter, are supplied to a microcomputer for evaluation thereof. The microprocessor causes the rotation direction of the first motor (step motor) and therefore the movement direction of the cartridge pivot unit to be reversed at a first point in time (when the play of the train of the cartridge pivot unit has completely occurred) by resetting a count value of a counter to zero at the first point in time and, as of the first point in time; by counting pulses whose number corresponds to the rotation movement of the motor shaft of the first motor (step motor), and by storing the immediately following determined digital measurement values in the working memory, and by digitally comparing the immediately following digitized measurement values. At a second point in time the counter is stopped and the counter state is stored as "play" in the working memory. The second point in time is reached when at least one singular change is detected in which the difference of the immediately adjacent digital measurement values is greater than a threshold, or when a repeated change of the difference of the immediately adjacent digital measurement values is detected in successive measurements, wherein the difference tends to rise.

The rotation angle transmitter and the microprocessor controller that are already present in many printers are used to determine the play of the cartridge pivot unit in the measuring arrangement. The total angle magnitude that the rotation angle transmitter can detect is greater than the pivot range. Upon assembly of the inkjet printing system of a franking machine, the rotation angle transmitter is adjusted such that approximately equal angle magnitude margins are reserved at both ends of the pivot range. The play of the cartridge pivot unit is the sum of all plays of a worm gear pair. A mechanical stop on a frame of the inkjet printing system exists in the cartridge pivot unit both at a minimal position (printing position) and a maximum position (exchange position). If the measurement voltage that can be tapped at the rotation angle transmitter does not change although the first motor (step motor) is activated, the cartridge pivot unit has reached an extreme position, i.e. a fixed stop. Starting from one of these extreme positions, the microprocessor controller can determine a number of steps for a step motor to activate each position of the cartridge pivot unit in the pivot range. Nevertheless, the invention proceeds from a mobile stop that is formed by a cleaning and sealing station (RDS). The cartridge pivot unit is first pivoted in the direction of the exchange position and then the RDS is moved into the sealing position, such that the cartridge pivot unit subsequently pivoted into the sealing position ultimately rests on the RDS and is pressed against it by gravity. The play of the worm gear pair is caused (permitted) to completely occur through further steps of the step motor. If the flights of the worm (which are coupled in terms of actuation) and a worm gear (segment) thereby driven are then rotated in the opposite direction, the play of the worm gear pair must initially be overcome before the cartridge pivot unit actually departs (separates from) the RDS. The play results from the number of the steps of the first motor (step motor) that are needed to cause the cartridge pivot unit to actually move.

The invention has the advantage that the time duration of the pivoting of the cartridge pivot unit with the at least one inkjet print head from the exchange position into the sealing position to stop at the RDS and back again into the exchange position is short relative to a pivoting of the cartridge pivot unit onto the fixed stop in the printing position. The cartridge pivot unit is held by its inherent weight in the sealing position while the drive direction of the train is reversed. Until the cartridge pivot unit moves and is pivoted back into the exchange position, its play can be determined very precisely in an advantageous manner. The precision in the pivoting into the printing position is increased by taking this play into consideration, such that a fixed stop in the printing position at the frame of the inkjet printing system, that is provided to prevent an overrun of the printing position, could even be omitted.

DESCRIPTION OF THE PREFERRED EMBODIMENTS

Figure 1:
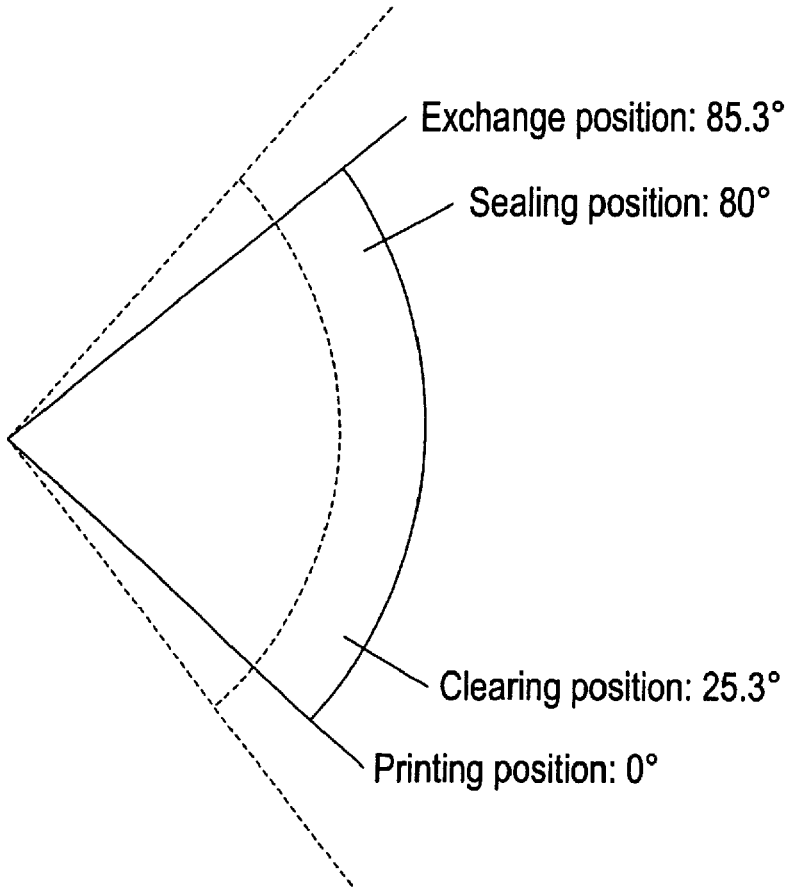
FIG. 1 illustrates the positions of the rotation angle in a printer device.

FIG. 1 shows a representation of the positions of the rotation angle of a cartridge pivot unit. At least one inkjet print head of a cartridge can be moved into the desired position with the aid of the cartridge pivot unit. The cartridge pivot unit can occupy the position shown in FIG. 1 and has a pivot range of 85.3°. A printing position corresponds to an angle of zero degrees. A clearing position near the printing position corresponds to an angle of 25.3°, a sealing position corresponds to an angle of 80° and an exchange position corresponds to an angle of 85.3°. The cartridge pivot unit is moved by a worm drive with a prime mover that is not shown, advantageously with the use of a step motor. A reserve angle range (margin) lies at both boundaries of the aforementioned angle range of 85.3°. If a known rotation angle transmitter that has an electrical usable angle of 95° is used to determine the play of the cartridge pivot unit, the approximately equal angle reserves amount to 4.85°±4° at both ends of the pivot range of 85.3°.

Figure 2:
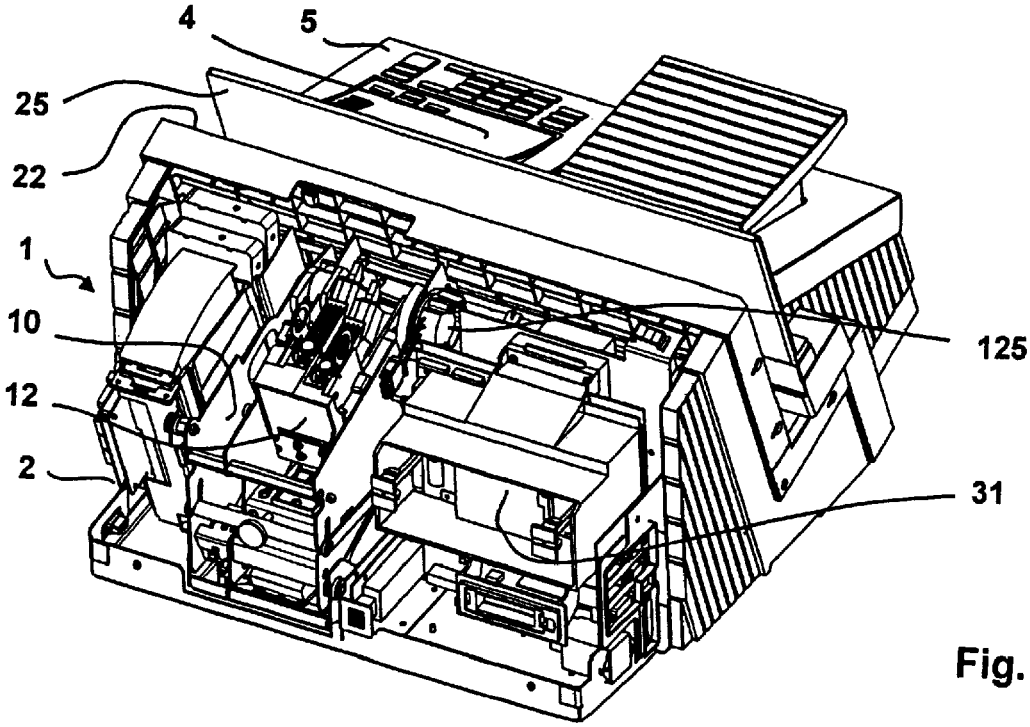
FIG. 2 is a perspective view of a franking machine of the Centormail® type from behind.

A perspective view of a franking machine of the Centormail® type is shown in FIG. 2 from the rear, left and above, with opened housing rear wall. A chassis (not visible) supports a new inkjet printing system 1 and a known transport device comparable with the Jetmail® franking machine. The inkjet printing system has an RDS (not visible) arranged such that it can move at the bottom in the frame 10 and the cartridge pivot unit 12 arranged such that it can pivot above said RDS, which cartridge pivot unit 12 is driven by a first motor via a worm gear pair. The movement of the RDS ensues by means of a second motor (not visible). The transport device is driven (not visible) by a third motor arranged near the floor on the mail output side 2 of the franking machine. The cartridge pivot unit 12 is shown in FIG. 2 in a sealing position, wherein the at least one inkjet print head is positioned opposite the RDS. The frame 10 is positively fastened on the chassis such that a parallelism is achieved between transport direction and the print lines to be printed on a mail piece. In the frame 10 the cartridge pivot unit 12 equipped with at least one inkjet print head is arranged such that it can pivot behind a guide plate 22 which has a printing window (not visible). If the cartridge pivot unit 12 is pivoted into a printing position, the at least one inkjet print head is then positioned in the printing window. A clearing position is arranged near the printing position so that the time duration for the movement of the cartridge pivot unit 12 with the at least one inkjet print head into the clearing position and back again into the printing position is much shorter relative to the movement into the sealing position. Further details are described in DE 10 2005 052 150 A1 ("Device to clean an inkjet print head"). A rotation angle transmitter 125 which, upon being tapped, outputs an analog component voltage corresponding to the set rotation angle is used as a rotation movement sensor. A mainboard with a microprocessor controller is arranged at the mail input side of the franking machine under a cover 31. The franking machine is equipped with a Plexiglas plate 25 to protect against contact and with a guide plate 22 for mail pieces which are angled beyond the vertical, such that the mail pieces rest on the guide plate 22. The keyboard 4 and display device 5 which are connected in a known manner with the microprocessor controller as a user interface are arranged on the other side of the Plexiglas plate 25. After a suitable input via user interface, the microprocessor controller of the franking machine can now also be used to assist a service technician or another authorized person to conduct a test of the play of the cartridge pivot unit simply and without opening the machine. The digital measurement values, a threshold, the counter state of the counter or, respectively, the play P can be interrogated and output as needed via the user interface 4, 5.

A microprocessor of a microcomputer is programmed (by a program stored in the program memory of the microcomputer) to activate the first motor in order to drive the cartridge pivot unit 12 via a train by means of the first motor; and to activate the second motor to drive the cleaning and sealing station RDS which is moved into the sealing position;

wherein the cartridge pivot unit 12 is pivoted from an exchange position into a sealing position and strikes the cleaning and sealing station RDS and is pressed against it as a result of being pivoted further. Evaluation of the play of the cartridge pivot unit begins with being pivoted away from the sealing position back into the exchange position at a first point in time and ends at a second point in time when the change of the measurement values representative of the play again conforms with the pulses that are measured at the input side at the train, i.e. conforms with step pulses by means of which the first motor is activated, wherein the first motor is a stepper motor.

Figure 3:
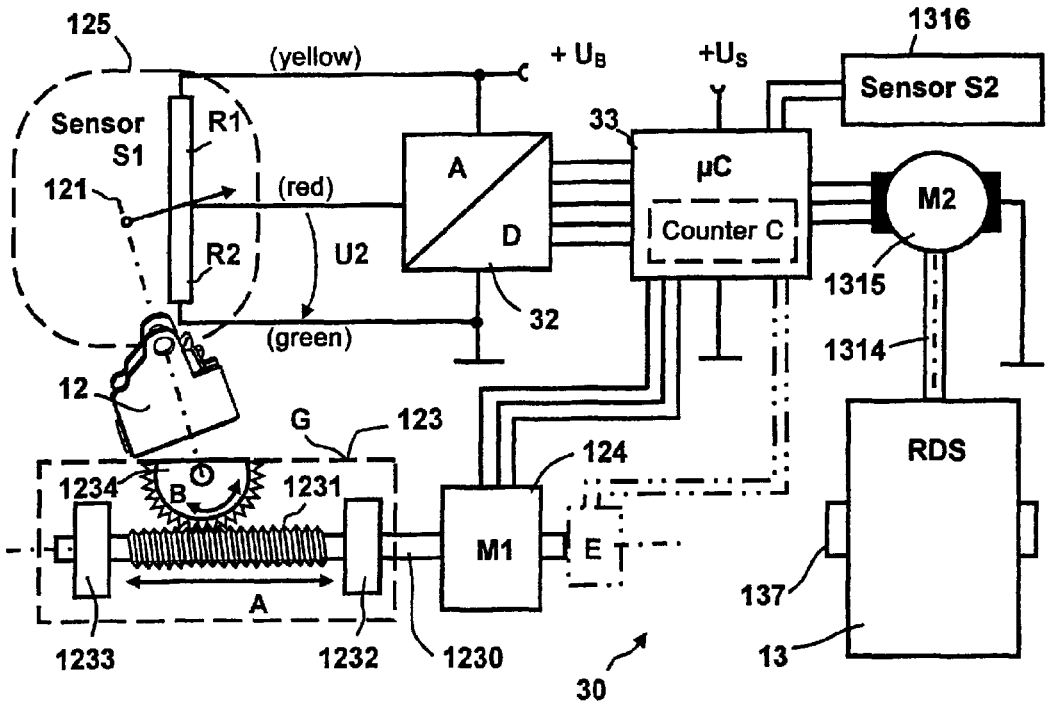
FIG. 3 is a block diagram for a measuring arrangement with microcomputer.

A block diagram of a measuring arrangement with microcomputer to determine the play of a cartridge pivot unit is shown in FIG. 3. A rotation movement sensor S1 is a rotation angle transmitter 125. An operating voltage $U_B$ is present at the rotation angle transmitter 125, which forms a voltage divider with the total resistance of 4 kΩ±20% with the component resistances R1, R2. The middle tap of the voltage divider is shifted via a rotation around the axis 121 upon pivoting of the cartridge pivot unit 12 and a variable analog component voltage $U2=U_B \cdot R2/(R1+R2)$ declines across the component resistor R2. The measurable component voltage U2 of the cartridge pivot unit pivoted into printing position is minimal and the measurable component voltage U2 of the cartridge pivot unit pivoted into exchange position is maximum.

The rotation angle transmitter 125 is, for example, an absolute position encoder of the MPR 403 or PMR411 type by TWK-Elektronic GmbH which is connected with operating voltage with its yellow connection line and with ground potential with its green connection line. The analog component voltage U2 at the middle tap (red) of the voltage divider is converted by an analog/digital converter 32 into a digital data value X2 that is digitally processed further or stored. For this purpose, the analog/digital converter 32 is connected at the output side with the digital inputs of a microcontroller (PC) 33. The analog/digital converter 32 and the microcomputer (microcontroller) 33 are components of the microprocessor controller that is used to determine the play of the cartridge pivot unit. The microcontroller furthermore has a program and data memory. A number of sensors and actuators are connected to the microcontroller (μC) 33.

A first motor M1 (124) to drive the cartridge pivot unit, a second motor M2 (1315) to drive the RDS 13 and a third motor (not necessary for measurement) to drive a mail piece transport device (not shown) are connected to the output side of the microcontroller. The first motor M1 (124) with its motor shaft is connected without slippage to, or is mechanically identical with, the shaft 1230 of a worm gear pair 123. The shaft 1230 carries a worm 1231 and is supported on both sides of the worm 1231 in ball bearings 1232 and 1233 that are subject to a play A of approximately 50 to 1000 μm.

The teeth of a worm gear or of a worm gear segment 1234, which is supported such that it can rotate around an axle 121, engage the flights of the worm 1231. Both the attachment and the teeth can exhibit a play of approximately 50 to 300 μm upon engagement in the screw. The cartridge pivot unit supported such that it can rotate on the axle 121 is mechanically connected without slippage with a potentiometer of the rotation angle transmitter 125. As soon as the cartridge pivot unit is rotated on the axle 121, the rotation angle transmitter 125 outputs at its middle tap a (normally modified) measurement voltage U2. No further change in the rotation angle can occur upon reaching the extreme positions and the sealing position. Upon moving the cartridge pivot unit with the first motor M1 (stepper motor) a certain play P occurs dependent on the respective position. This means that the stepper motor moves by a few steps before the component voltage at the rotation angle transmitter 125 (and the digital value resulting from this) changes. The play can be very large when a) the screw 1231 driven by the step motor 124 was not correctly mounted or
b) the screw driven by the step motor 124 has loosened during the operation of the inkjet printing system of the franking machine.

The play A of the worm 1231 occurs in the axial direction. Play B exists between the worm 1231 and the segment 1234 worm gear. For the following reasons it is necessary to know the play of the cartridge pivot unit:

a) In order to obtain an imprint that corresponds to the requirements of the postal authorities, it is required to move the cartridge pivot unit into the printing position and to keep it there with a precision of ±1°. To achieve a specific position of the cartridge pivot unit, the step motor most travel a precisely determinable number of steps; it is required that no play be present. However, since play always occurs, it is necessary to know this play in order to achieve the aforementioned precision or at least to be able to assess whether this precision can be achieved in the tested inkjet printing system.
b) It can occur that the train is stiff or becomes stiff in the course of time. In this case the cartridge pivot unit could not reach the desired position with a predetermined step count. In order to be able to assess whether the train is qualitatively poor or whether play exists, it is necessary to know the play.

Due to the use of a step motor 124, the necessity to detect the rotation of the motor axle at the input side at the train via an encoder E is advantageously dispensed with. The optional encoder and its connection lines are therefore drawn as a dash-dot-dot line. The analog/digital converter 32 can alternatively be an internal component of the microcomputer 33.

The measuring arrangement 30 according to FIG. 3 also shows an RDS. A second sensor S2 1316 for a reference point setting of the RDS is connected with the microcontroller μC at the input side and a second motor M2 1315 is connected with the microcontroller μC at the output side. For example, the second motor M2 (1315) has a spindle train in order to displace the RDS 13, which glides with a movable sled 137 into the slots of the wall plate in order to initially reach an exchange position via a cartridge pivot unit 12 pivoted by 85.3°. Due to the RDS in rest position, the second sensor S2 (1316) is activated for a reference point setting. The cartridge pivot unit can at the same time persist in the exchange position. Both cartridge pivot unit and the RDS are moved into the sealing position, such that the cartridge pivot unit strikes the RDS and is pressed against it. As the play of the screw is completely occurring depending on the mobility of the screw in its bearings, the microcontroller counts the steps which the first motor M1 (step motor 124) executes after activation thereof. The digitized measurement values X2 are supplied via the rotation angle transmitter 125 and the analog/digital converter 32 to the microcontroller 33 for the purpose of storage. Each change of the measured digital value X2 is also registered. A first point in time $t_1$ (start point in time) is reached when the difference Δ of the immediately adjacent (successive) measurement values is minimal. For example, the difference Δ of the immediately adjacent measurement values $X2_n - X_{2n-1}$ is equal to zero. The screw is then rotated in steps in the opposite direction by the step motor (M1) 124, meaning that the cartridge pivot unit 12 moves away from the RDS 13. Before the cartridge pivot unit actually moves, the play must be overcome again. The play P=A+B of the cartridge pivot unit can be determined from the number of steps that are necessary before the cartridge pivot unit moves and the ADC value $X2_n$ changes. A second point in time $t_2$ (stop point in time) is reached when the play P is overcome, i.e. when the ADC value $X2_n$ changes again significantly relative to the immediately adjacent preceding value $X2_{n-1}$. The second point in time $t_2$ is reached when at least one singular change is detected in which the difference Δ of the immediately adjacent digital measurement values is greater than a threshold D, or when a repeated change of the difference Δ of the immediately adjacent digital measurement values is detected in successive measurements, wherein the difference Δ rises (tendentially). An empirically determined threshold D can be predetermined to establish whether the play was overcome. A repeated change of the difference Δ comprises the following cases:

- A first change is smaller than a subsequent second change of the difference Δ.
- A first change is equal to a subsequent second change of the difference Δ but smaller than a subsequent third change of the difference Δ.
- A first change is greater than a subsequent second change of the difference Δ but smaller than a subsequent third change of the difference Δ.
- A first change is greater than or equal to a subsequent second change of the difference Δ but smaller than any of the subsequent further changes of the difference Δ.

Figure 4:
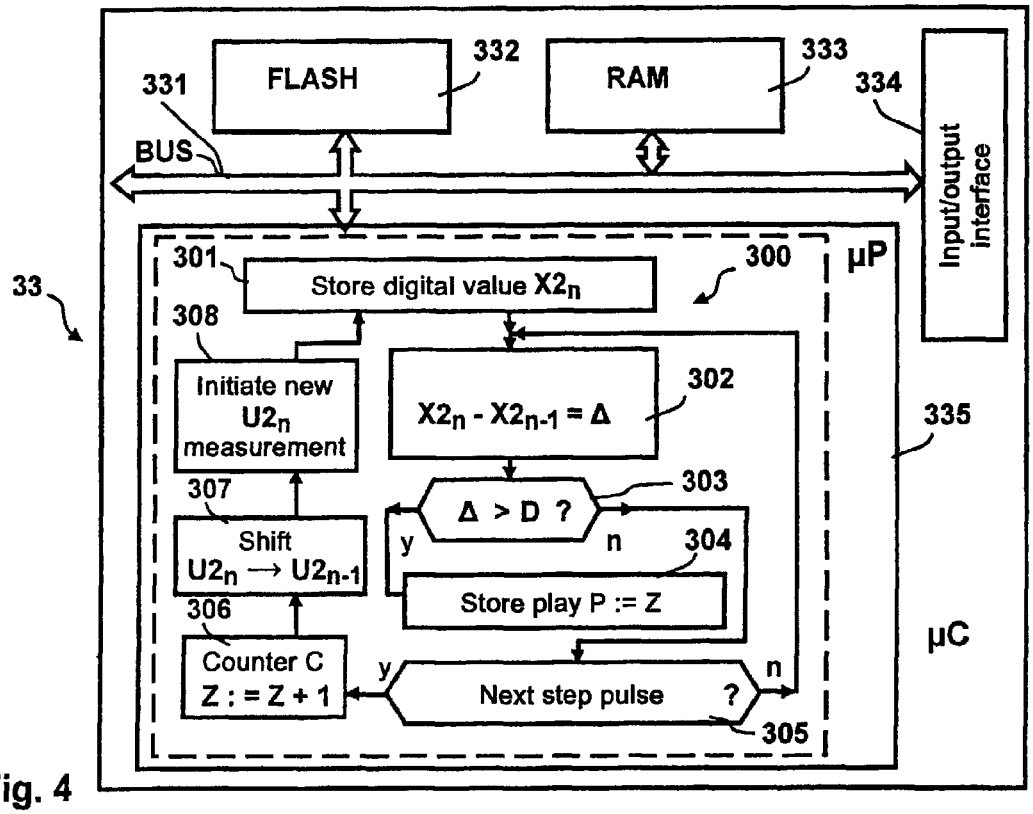
FIG. 4 illustrates the functioning of the microcomputer.

A presentation of the function of the microcomputer in the determination of the play of the cartridge pivot unit arises from FIG. 4 while the cartridge pivot unit is moved away from the RDS in the direction of the printing position. The remaining functionality of the microcomputer before and after this function is explained later. The microcomputer 33 has at least one program memory (FLASH) 332, a working memory (RAM) 333 and an input/output circuit 334 which are connected with a microprocessor (μP) 335 via a BUS 331. An initial value, namely a digital value $X2_{n-1}$ measured at a previous point in time, is stored at a first predetermined memory space in the working memory (RAM) 333. The microprocessor (μP) 335 is programmed (via a program 300 stored in the program memory (FLASH) 332) to store a just-measured digital value $X2_n$ at a second predetermined memory space in the working memory (RAM) 333 in Step 301. The play has occurred completely when both digital values $X2_n$ and $X2_{n-1}$ differ only slightly or given a difference $X2_n - X2_{n-1} = \Delta \rightarrow 0$ (approaching zero). In the microprocessor (μP) 335, a digital comparator V is realized in hardware and/or software the function of which is explained by a first comparison step 302 and a first interrogation step 303. The step 303 it is queried whether a selectable predetermined comparison value D (threshold) has already been reached or exceeded by the difference Δ. If the selectable, predetermined comparison value D has not yet been exceeded by the difference Δ, the workflow branches to the second interrogation step 305 and it is queried whether a next step pulse for the first step motor M1 has already been output. In the event that this is not the case, the workflow then branches back to the beginning of the first comparison step 302. However, if the rotation direction of the screw was reversed at a first point in time $t_1$ and a next step pulse for the first step motor (M1) 123 was already output, a counter is prompted to increment its count value Z by one, i.e. to counter further by one step. The counter C is realized in hardware and/or software as a counter software module, and its incrementing function Z:=Z+1 is indicted in the following step 306. Indices are subsequently changed since the current measurement value or, respectively, digital value becomes the new predecessor (i.e. the association with the memory spaces is shifted), which arises from Step 307. Alternatively, a shift register is realized and operated. In the following step a command to implement a subsequent, new $U2_n$ analog value measurement is output by the microprocessor at the output unit. The microprocessor 335 now again arrives at the first Step 301 and is ready to store a further measurement value $X2_n$ measured and digitized (by means of the analog/digital converter) in RAM 333.

However, if the selectable, predetermined comparison value C is exceeded by the difference Δ, at Step 304 the workflow branches from the first interrogation step 302 for the purpose of storing the play P=Z in RAM 333. The value of the play P=Z can be output as needed via the input/output unit 334 for the purpose of display. If the criterion in the first interrogation step is satisfied, this means that the play P was overcome and that the change of the measurement values X2 again conforms with the step pulses.

Figure 5:
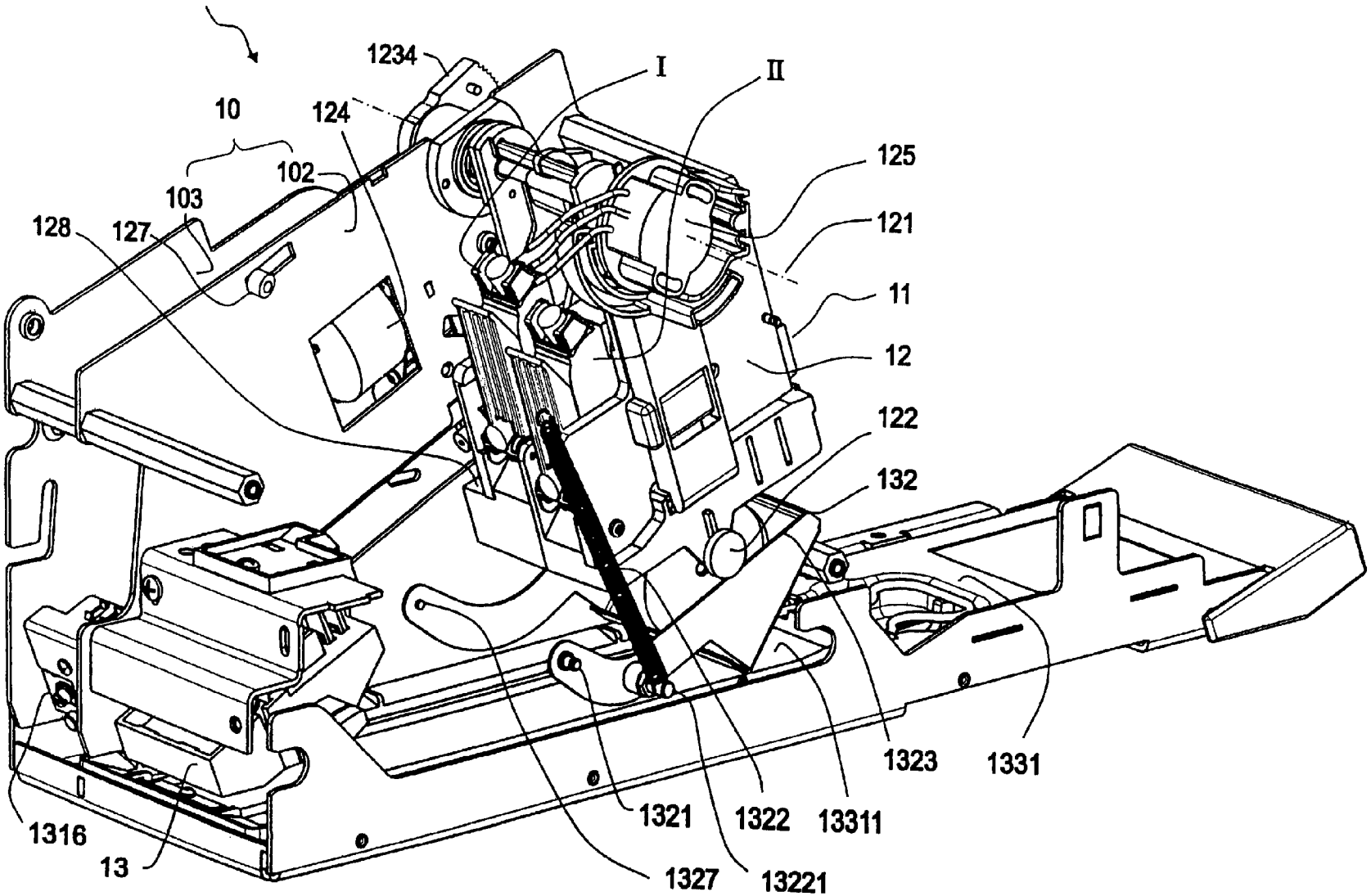
FIG. 5 shows the inkjet printing system, with a side view from the rear, above and to the left of a cartridge pivot unit pivoted into a printing position.

A representation of the inkjet printing system with side view of a cartridge pivot unit from the left, rear, above is shown in FIG. 5, wherein the inkjet print heads of both cartridges are positioned in the printing position. A first wall plate of the frame 10 was omitted for reasons of better presentation of the details. The inkjet printing system 1 has a cartridge pivot unit 12 that can be pivoted in the frame 10, which cartridge pivot unit 12 carries at least one ink cartridge 1, 11 with inkjet print head 11. At least one first motor 124 is connected with a microprocessor controller (not shown) to shift the cartridge pivot unit 12, and a rotation transmitter 125 is connected with said microprocessor controller for feedback. A respective train for the cartridge pivot unit 12 and for the cleaning and sealing device 13 is provided for adjustment of the different function positions in a known manner between the second and third wall plate 102, 103 of the frame 10. In the example a worm gear pair for cartridge pivot unit 12 is driven by a step motor 124.

An adjustable stop 127 in the form of a bolt that can be screwed in is shown at the second wall plate 102 of the frame 10.

An edge 128 of the cartridge pivot unit 12 arranged on the hidden side of the base strikes this stop when said cartridge pivot unit 12 is pivoted into the other extreme position (not shown), i.e. the exchange position. A worm gear segment 1234 of the worm gear pair (not visible) which is arranged between the second wall plate 102 and the third wall plate 103 is attached on an end of a shaft (rotatable around the rotation axis 121) remote from the rotation transmitter 125. The first step motor 124 to drive the worm gear pair is arranged in an opening near the middle of the second wall plate 102.

A baffle plate 132 which is used when the cartridge pivot unit 12 is pivoted by 25.3° into a clearing position is attached by means of pivots 1321 and 1327 on the first wall plate (not shown) and on the second wall plate 102 such that it can rotate. A wheel 122 is fastened on the cartridge pivot unit 12 such that it can rotate and a guide edge 1323 is molded on a lateral rocker of the baffle plate 132. The baffle plate 132 is connected with the frame 10 via a tension spring 1322 which pre-stresses the baffle plate 132, whereby the wheel 122 non-positively rests on the guide edge 1323. A fastening pin 13221 that is connected with one end of the tension spring 1322 is mounted on the baffle plate 132. The wheel 122, the guide edge 1323 and the tension spring 1322 form a rocker (crank) guide for the baffle plate 132. The guide edge 1323 is advantageously formed on the left lateral rocker of the baffle plate 132. The at least one inkjet print head is pivoted into the printing position and the baffle plate 132 is lowered via the movement of the cartridge pivot unit 12. That occurs counter to the effect of the tension spring 1322, wherein the wheel 122 mounted on the cartridge pivot unit 12 engages with a guide edge 1323 of the left lateral rocker of the baffle plate 132 and is moved to the freely oscillating end of the rocker until the fastening pin 13221 arrives at an upper stop in a slot. An insert 1331 is provided below the cleaning and sealing device 13 for the accommodation of a fleece 13311.

Figure 6:
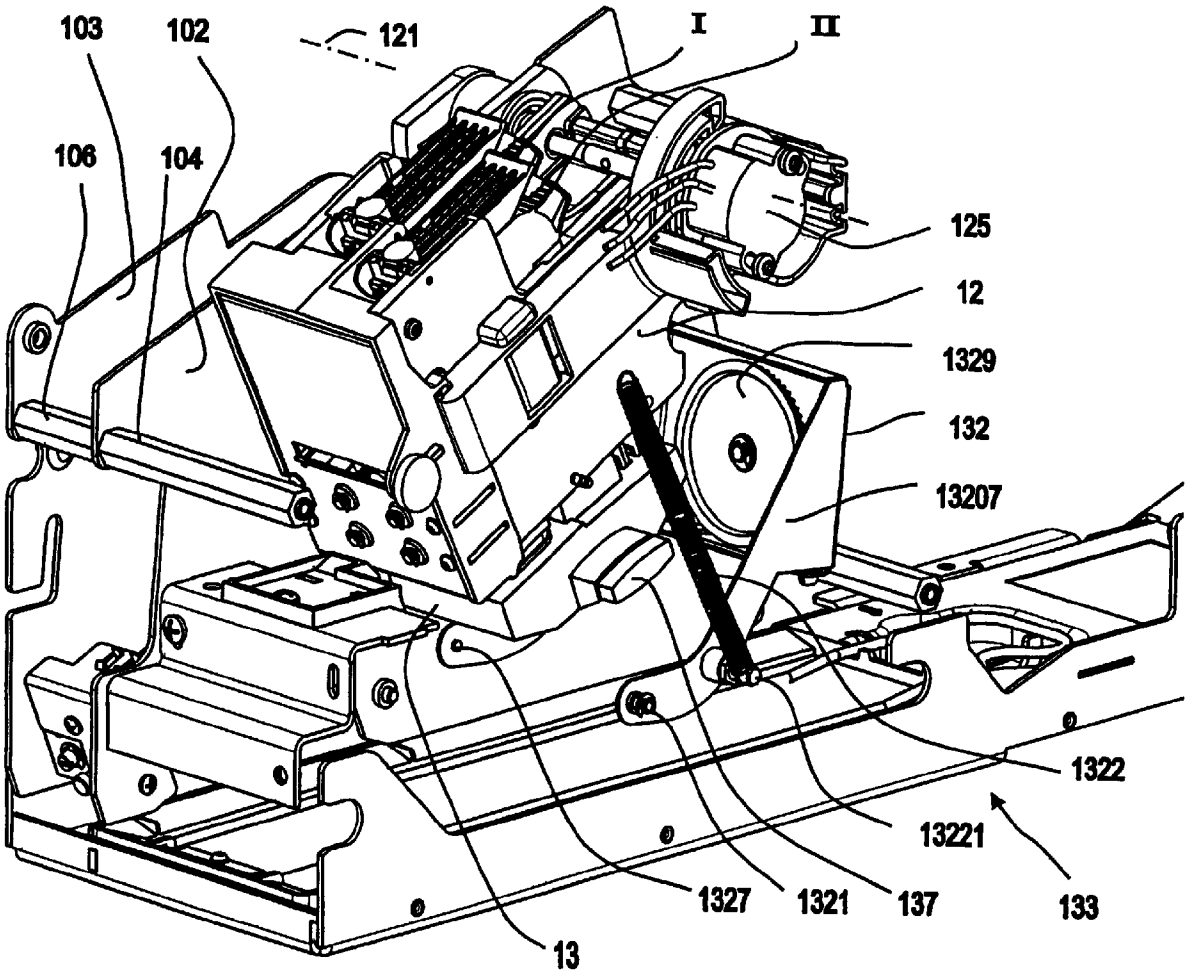
FIG. 6 sows the inkjet printing system, with a side view from the rear, above and to the left of a cartridge pivot unit pivoted into the sealing position.

A representation of the inkjet printing system is shown in FIG. 6 with side view from the left, rear, top of a cartridge pivot unit, wherein the inkjet print heads of both cartridges are positioned in the sealing position. Rear spacers 106, 104 are arranged between the first and second wall plate 102 of the frame and between the second and third wall plate 103 of the frame. The first wall plate is also omitted here for better presentation of the details. The cartridge pivot unit 12 is arranged between the first and second wall plate 102 of the frame and can be pivoted on the rotation axis 121. The latter lies above the rear spacers 104, 106 and near and above the (covered) front spacers. It is provided that the cleaning and sealing device 13 as well as a correspondingly adapted baffle plate 132 are arranged below the cartridge pivot unit 12. The cleaning and sealing device 13 is arranged height-adjustable in the frame. Slots running at an angle in the first and second wall plate 102 and a sled 137 movable from the back side of the frame downward at an angle from the bottom upwards to the middle of the wall plates of the frame serve for this height adjustment, in particular between the rear end of the ink sump 133 and the aforementioned front spacers. The baffle plate 132 is rotated on the pivots 1321, 1327 due to the tension spring 1322 acting via the fastening pin 13221 and again takes up an identical position as in the clearing position. An ink sump 13 below the cleaning and sealing device 13 is fashioned as an insert. To pivot the cartridge pivot unit 12 from the exchange position/(printing position) into the sealing position at the sealing station, a shorter/(longer) time duration is required relative to the pivoting from the printing position into the clearing position at the baffle plate.

Figure 7:
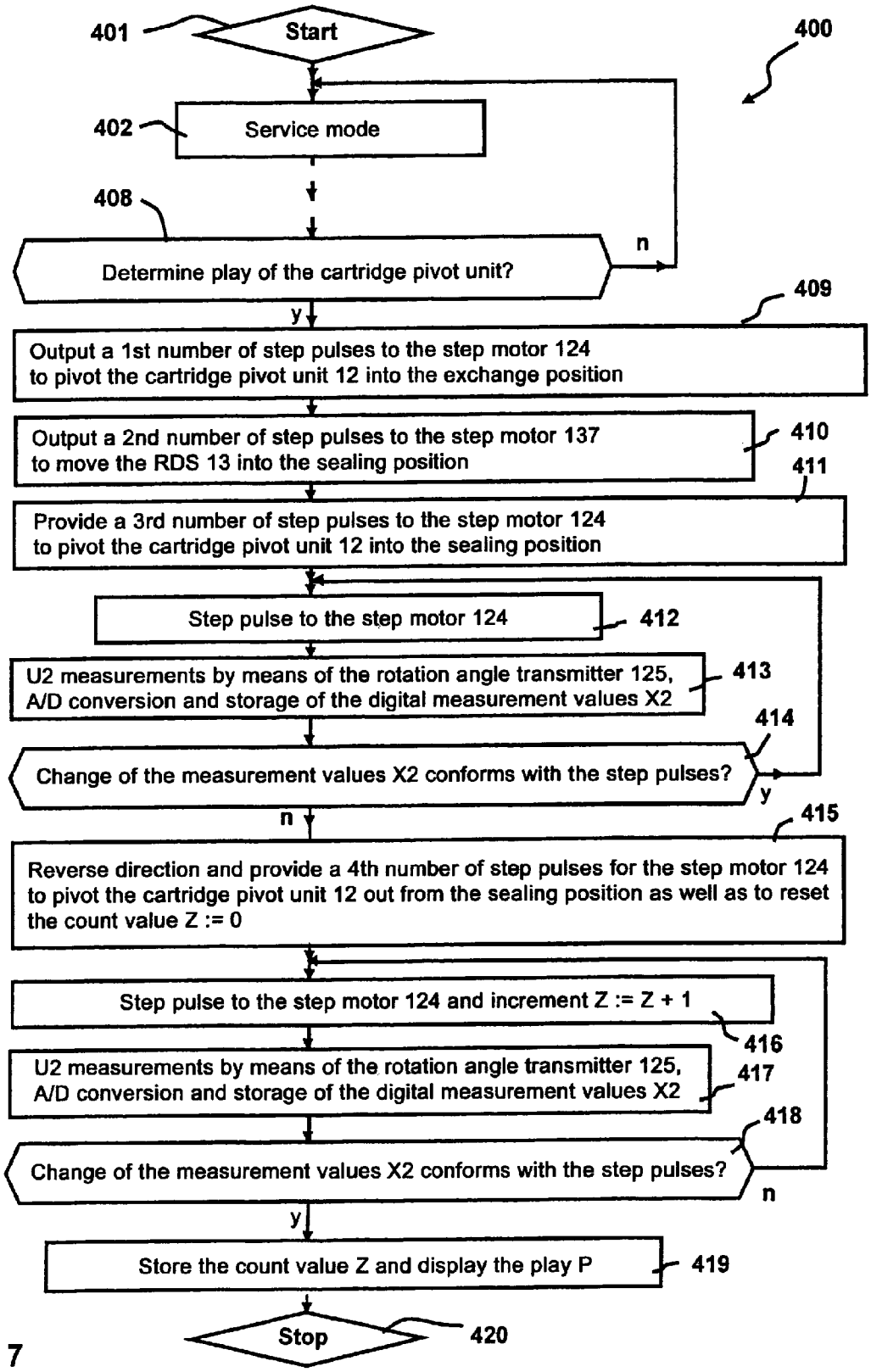
FIG. 7 is a flowchart for an embodiment of the measurement procedure in accordance with the invention.

A flowchart for the measurement workflow is shown in FIG. 7. The measurement workflow 400 requires that a corresponding program is stored in a program memory of the microcontroller. A user input (not shown) ensues after the start 401 of the franking machine. A service mode 402 with which additional inputs are possible is set by the authorized operator. In the additional Steps 403 through 407 (not shown) and in the shown Step 408 it is queried which setting was selected by the user. For example, setting into service mode 402 was selected by a service technician in order to determine the play of the cartridge pivot unit. In the first interrogation Step 408 the last setting is queried and the workflow transitions to the subsequent Step 409 when it is desired to determine the play of the cartridge pivot unit. However, if the latter is not desired, the workflow branches back to the service mode 402. In the first Step 409 after the first interrogation, an output of a first number of step pulses to the step motor (M1) ensues to pivot the cartridge pivot unit into the exchange position. In the subsequent second Step 410 an output of a second number of step pulses ensues to the second step motor (M2) to move the RDS from a rest position to the sealing position. In the subsequent third Step 411 a provision of a third number of step pulses to the first step motor (M1) ensues to pivot the cartridge pivot unit 12 from the exchange position into the sealing position. In the subsequent fourth Step 412 an output of a step pulse to the first step motor (M1) ensues. In the fifth Step 413, clock-controlled U2 measurements by means of the rotation angle transmitter; an A/D conversion of the analog U2 measurement values into digital measurement values X2; and a storage of the digital measurement values X2 in a working memory ensue. The latter also serves as a data memory of data of other measurements and of parameters of the inkjet printing system. The microcontroller can conduct calculations or comparisons with the stored data in order to determine whether a change of the measurement values X2 conforms with the step pulses, which is queried in a second interrogation Step 414. If the change of the measurement values X2 runs in conformity, the workflow branches back to the fourth Step 412 in order to output a step pulse and to subsequently continue the measurement. Alternatively, a circuit can also be realized in hardware in the microcontroller in order to conduct the aforementioned comparisons.

If the pivot device rests on the RDS and is pressed against it, the play of the worm gear pair is completely expressed. This leads to the situation that there is no longer any change of the measurement values X2 although additional step pulses are output by the microcontroller. No change of the measurement values X2 then ensues in conformity with the step pulses. If that is established in the second interrogation Step 414, the workflow branches to the sixth Step 415 for the purpose of carrying out a direction reversal and providing a fourth number of step pulses for the first step motor 124 to pivot the cartridge pivot unit out from the sealing position. A worm gear (segment) of the worm gear pair is thereby rotated in steps in the opposite direction and the cartridge pivot unit is thus moved away from the RDS. Moreover, a resetting of the count value Z:=0 of a counter C to zero ensues in a sixth Step 415. In a seventh Step 416 a step pulse is output to the first step motor 124 and the counter value of the counter C is incremented by the value "one". Additional U2 measurements by means of the rotation angle transmitter 125, an A/D conversion and storage of the digital measurement values ensue in a subsequent eighth Step 127. The U2 measurements by means of the rotation angle transmitter 125, the A/D conversion and the storage of the digital measurement values X2 are continued until it is established in a third interrogation Step 418 that the change of the measurement values X2 again conforms with the step pulses, wherein the fourth number Z of step pulses counted at this point in time at the first step motor 124 yields the play P, which is stored in a subsequent ninth Step 419. However, if it is established in the third interrogation Step 418 that the change of the measurement values X2 does not conform with the step pulses, the workflow branches back to the beginning of the seventh Step 416 for the purpose of outputting an additional step pulse and incrementing the count value Z. After storing and display of the play P in the ninth Step 419, a stop Step 420 for the routine is reached. However, additional steps in order to move the cartridge pivot unit further into the exchange position can be executed (not shown) before a stop.

The invention is not limited to a present embodiment with a worm gear pair 123. Any other suitable train G can likewise be used.

The invention is also not limited to the present embodiment with a step motor. A direct current motor which is controlled with pulse duration-modulated field coil pulses could be used just as well as a first motor M1. An encoder E with an encoder wheel and associated light barrier is attached on the drive shaft 1230 of the direct current motor, which encoder wheel emits a number of pulses upon its rotation, which pulses can be counted by the microcomputer in order to determine the rotation of the motor drive shaft 1230 at the input side of the train G. The rotation movement sensor S1 can measure a rotation movement at the output side of the train G in analog and feed this to a converter that generates the digital measurement values. However, the converter is not necessary if a digital rotation movement sensor (for example here as well an encoder) is used to generate digitally countable pulses.

Other embodiments of the invention for other types of drive motors can thus clearly be developed based on fundamental ideas of the invention.

Although modifications and changes may be suggested by those skilled in the art, it is the intention of the inventors to embody within the patent warranted hereon all changes and modifications as reasonably and properly come within the scope of their contribution to the art.

We claim as our invention:

1. A measuring arrangement that determines play of an inkjet cartridge pivot unit, comprising:

an inkjet cartridge;

a moveable cleaning and sealing unit configured to move into a sealing position with respect to said inkjet cartridge to clean said inkjet cartridge;

a cartridge pivot unit connected to said inkjet cartridge and configured to pivot said inkjet cartridge relative to a stop formed by said cleaning and sealing unit;

a motor and a gear train, said motor driving said cartridge pivot unit via the gear train, said gear train embodying mechanical play therein such that said cartridge pivot unit begins to move away from said stop only when said play is overcome;

a pulse generator that emits pulses corresponding to operation of said motor;

a movement sensor that detects movement of said cartridge pivot unit and emits a movement sensor output corresponding to the detected movement; and a counter that counts said pulses beginning at a start time when said motor begins to operate to move said cartridge pivot unit away from said stop and that ends at a stop time when, after said cartridge pivot unit mechanically separates from said stop, movement of the cartridge pivot unit, as represented by said movement sensor output, conforms to operation of said motor as represented by said pulses, with said count at said stop time representing said play.

2. A measuring arrangement as claimed in claim 1 comprising:

a processor programmed to reverse a rotation direction of said motor and thus to also reverse a direction of movement of said cartridge pivot unit a first point in time $t_1$ when said play is completely overcome, said processor activating said counter to begin counting said pulses at said time $t_1$;

a working memory accessible by said processor in which successive digitized measurement values produced from said movement sensor output are stored;

a digital comparator having access to said working memory that compares adjacent ones of said successive digitized measurement values to identify a difference therebetween, said processor being supplied with said difference from said comparator and setting said time $t_1$ dependent on said difference, and said processor being programmed to stop said counter at a second point in time $t_2$, also dependent on said difference, corresponding to said stop time.

3. A measuring arrangement as claimed in claim 2 wherein said processor activates said counter at said time $t_1$ when said difference is minimal or zero, and resets a count value of said counter to zero at said first point in time $t_1$.

4. A measuring arrangement as claimed in claim 2 wherein said processor stops counting by said counter at said second point in time $t_2$ when said difference is greater than a predetermined threshold, or when said difference changes for respectively different pairs of adjacent, successive digitized measurement values.

5. A measuring arrangement as claimed in claim 2 wherein said motor is a first motor, and comprising a second motor connected to said cleaning and sealing station that drives said cleaning and filling station to move said cleaning and sealing station into said sealing position, and wherein said first and second motors are also electrically operated by said microprocessor, and wherein said microprocessor is programmed to coordinate control of said first motor and said second motor to cause said cartridge pivot unit to pivot from an exchange position into said sealing position to strike against said stop formed by said cleaning and sealing station in said sealing position.

6. A measuring arrangement as claimed in claim 5 wherein said processor stops counting by said counter at said second point in time $t_2$ when said difference is greater than a predetermined threshold, or when said difference changes for respectively different pairs of adjacent, successive digitized measurement values, and wherein said processor is configured to operate said first motor and said second motor and to evaluate said digital measurement values to empirically determine said predetermined threshold.

7. A measuring arrangement as claimed in claim 2 wherein said counter and said digital comparator are formed by components selected from the group consisting of hardware components and software components.

8. A measuring arrangement as claimed in claim 2 comprising an analog-to-digital converter connected between said movement sensor and said micro-computer, said movement sensor emitting said movement sensor output as an analog voltage at a tap corresponding to a predetermined rotation angle, and wherein said analog-to-digital converter generates said digitized measurement values from said analog voltage.

9. A measuring arrangement as claimed in claim 8 wherein said motor is a direct current motor having a drive shaft, and wherein said pulse generator is an encoder that detects pulses indicative of rotation of said drive shaft at an input side of said gear train.

10. A measuring arrangement as claimed in claim 2 wherein said motor is a stepper motor and wherein said processor comprises said pulse generator and operates said motor with stepper pulses as the pulses counted by the counter, and wherein said gear train comprises a worm gear arrangement.

11. A measuring arrangement as claimed in claim 10 wherein said processor employs a criterion, selected from the group consisting of whether a change of said difference occurs or whether an exceeding of the threshold by said difference occurs, to determine when conformity exists between movement of said cartridge pivot unit as detected by said movement sensor and movement of said cartridge pivot unit produced by said motor.

12. A measurement method that determines play of an inkjet cartridge pivot unit in a device that comprises an inkjet cartridge, a moveable cleaning and sealing unit configured to move into a sealing position with respect to said inkjet cartridge to clean said inkjet cartridge, a cartridge pivot unit connected to said inkjet cartridge and configured to pivot said inkjet cartridge relative to a stop formed by said cleaning and sealing unit, a motor and a gear train, said motor driving said cartridge pivot unit via the gear train, said gear train embodying mechanical play therein such that said cartridge pivot unit begins to move away from said stop only when said play is overcome, said method comprising the steps of:

generating pulses corresponding to operation of said motor;

detecting movement of said cartridge pivot unit and emitting a movement signal corresponding to the detected movement; and automatically electronically counting said pulses beginning at a start time when said motor begins to operate to move said cartridge pivot unit away from said stop and that ends at a stop time when, after said cartridge pivot unit mechanically separates from said stop, movement of the cartridge pivot unit, as represented by said movement signal, conforms to operation of said motor as represented by said pulses, with said count at said stop time representing said play.

13. A measurement method as claimed in claim 12 comprising:

reversing a rotation direction of said motor and thus also reversing a direction of movement of said cartridge pivot unit a first point in time $t_1$ when said play is completely overcome, and beginning counting said pulses at said time $t_1$;

producing successive digitized measurement values from said movement signal;

automatically electronically comparing adjacent ones of said successive digitized measurement values to identify a difference therebetween, and setting said time $t_1$ dependent on said difference, and stopping said counting at a second point in time $t_2$, also dependent on said difference, corresponding to said stop time.

14. A measurement method as claimed in claim 13 comprising starting said counting at said time $t_1$ when said difference is minimal or zero, and resetting a count value for said counting to zero at said first point in time $t_1$.

15. A measurement method as claimed in claim 13 comprising stopping said counting at said second point in time $t_2$ when said difference is greater than a predetermined threshold, or when said difference changes for respectively different pairs of adjacent, successive digitized measurement values.

16. A measurement method as claimed in claim 13 wherein said motor is a first motor, and comprising a second motor connected to said cleaning and sealing station and driving said cleaning and filling station to move said cleaning and sealing station into said sealing position, and comprising coordinating control of said first motor and said second motor to cause said cartridge pivot unit to pivot from an exchange position into said sealing position to strike against said stop formed by said cleaning and sealing station in said sealing position.

17. A measurement method as claimed in claim 16 comprising stopping said counting at said second point in time $t_2$ when said difference is greater than a predetermined threshold, or when said difference changes for respectively different pairs of adjacent, successive digitized measurement values, and operating said first motor and said second motor and evaluating said digital measurement values to empirically determine said predetermined threshold.

18. A measurement method as claimed in claim 13 comprising emitting said movement signal as an analog voltage at a tap corresponding to a predetermined rotation angle, and generating said digitized measurement values from said analog voltage.

19. A measurement method as claimed in claim 18 wherein said motor is a direct current motor having a drive shaft, and comprising generating said pulses with an encoder that detects pulses indicative of rotation of said drive shaft at an input side of said gear train.

20. A measurement method as claimed in claim 13 wherein said motor is a stepper motor and said pulses are stepper pulses that operate said motor.

21. A measurement method as claimed in claim 20 comprising employing a criterion, selected from the group consisting of whether a change of said difference occurs or whether an exceeding of the threshold by said difference occurs, to determine when conformity exists between movement of said cartridge pivot unit as detected by said movement sensor and movement of said cartridge pivot unit produced by said motor.

* * * * *